United States Patent [19]

Peck

[11] 4,048,918

[45] Sept. 20, 1977

[54] STENCILING APPARATUS AND IDENTIFICATION SYSTEM

[75] Inventor: Gregory George Alexander Peck, Brisbane, Australia

[73] Assignee: Identicar Corporation of America, Watertown, Mass.

[21] Appl. No.: 629,650

[22] Filed: Nov. 6, 1975

[30] Foreign Application Priority Data

Aug. 13, 1975 Australia ..... 2784/75

[51] Int. Cl.[2] ..... B41F 15/36

[52] U.S. Cl. ..... 101/114; 51/427; 101/127.1

[58] Field of Search ..... 101/114, 126, 129, 368, 101/112, 127, 127.1, 128.1, 398, 399, 333; 51/8 R, HD, 8 BR, 11, 310, 311, 312

[56] References Cited

U.S. PATENT DOCUMENTS

| | | | |
|---|---|---|---|
| 1,075,555 | 10/1913 | Felix | 101/368 X |
| 1,225,712 | 5/1917 | Hoskins | 101/398 |
| 1,586,088 | 5/1926 | Jellow | 101/127.1 X |
| 1,781,258 | 11/1930 | Walker | 101/128.1 X |
| 2,152,274 | 3/1939 | Papazian | 101/114 |
| 2,487,366 | 11/1949 | Penno | 51/8 HD X |
| 3,137,978 | 6/1964 | Incantalupo | 51/312 |
| 3,624,966 | 12/1971 | Palmer | 51/8 HD |
| 3,906,674 | 9/1975 | Stone | 51/12 |

*Primary Examiner*—Edgar S. Burr
*Assistant Examiner*—R. E. Suter
*Attorney, Agent, or Firm*—William Nitkin

[57] ABSTRACT

An apparatus and method used for stenciling selected indicia upon and into surfaces of structures for identification purposes, the apparatus comprising a hollow body with air pressure release outlet means, an aperture in the body wherein a detachable stencil holding unit having a stencil receptacle for affixing desired unit stencils over said aperture and a unit for applying the stenciling medium from within said body to said indicia; and a method of automobile identification marking wherein stenciled markings are placed on the panes of glass of a vehicle, the markings on each vehicle being unique and stored with other information in a central depository, the information being retrievable.

5 Claims, 13 Drawing Figures

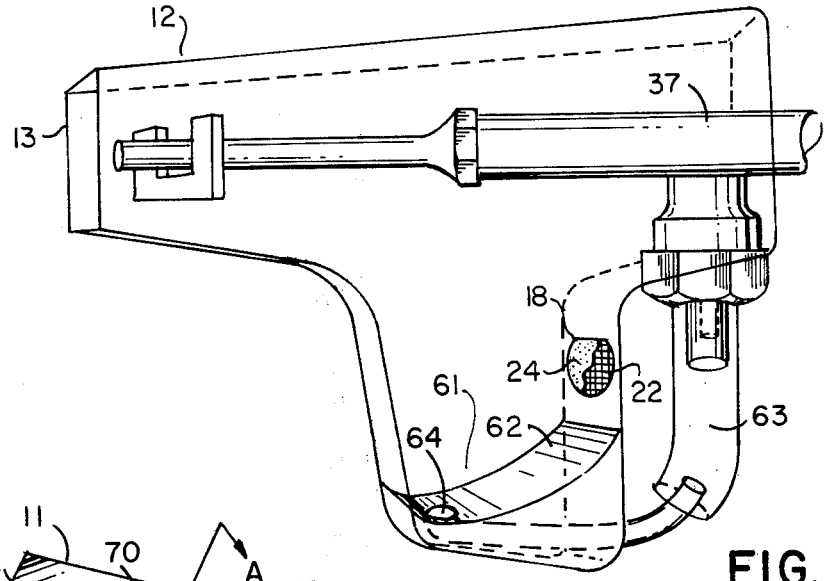
FIG. 6
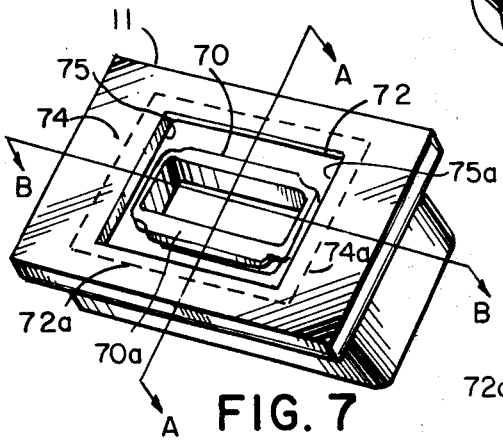
FIG. 7
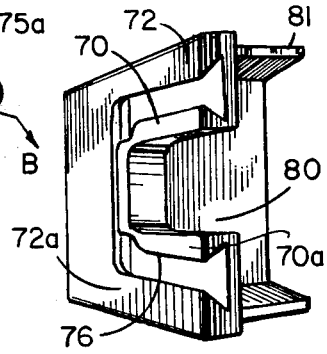
FIG. 8
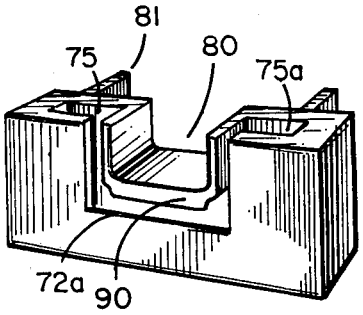
FIG. 9
FIG. 11
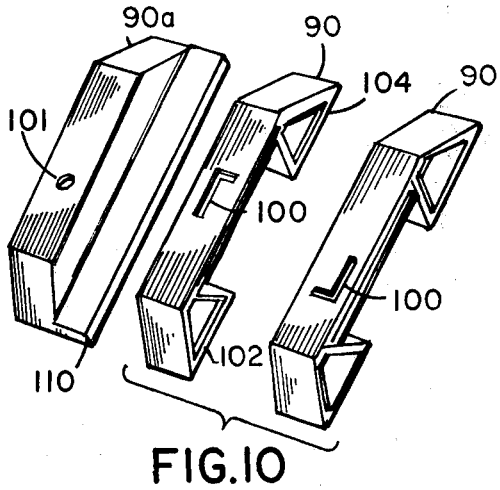
FIG. 10
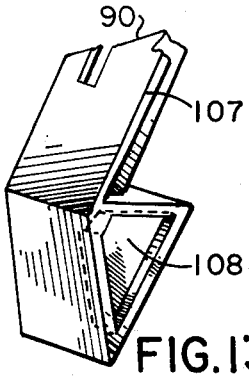
FIG. 13
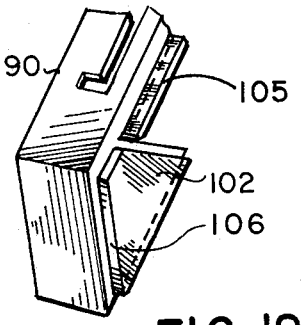
FIG. 12

STENCILING APPARATUS AND IDENTIFICATION SYSTEM

BACKGROUND OF THE INVENTION

1. Field of the Invention

This invention relates to the method and apparatus used for stenciling selected indicia upon and into surfaces of structures for identification purposes and more particularly relates to a system of automobile identification marking.

2. Description of the Prior Art

Stenciling apparatus are well known. In its most basic form a stencil consists of an impervious material perforated with letters, numbers or designs through which a substance such as paint, ink or other medium is forced onto the surface to be printed. Stencils are primarily used for lettering where ease of application, sharpness of line and ease of reproduction are important factors.

With regard to the present invention's system of automobile identification marking, it should be noted that currently automobile manufacturers usually place at least two identification marks on their automobiles. One mark is usually impressed into the motor block and the other is usually a plate welded somewhere onto the frame. These markings are utilized not only to identify the vehicle for title and registration purposes, but also to reduce car thefts by making it theoretically impossible for stolen vehicles to be sold as a state registry would recognize the identification numbers as being those of a stolen vehicle. Unfortunately, these identification marks can be altered or obliterated with the expenditure of time and effort by a skilled individual. The device of this invention embodies a new method of identification which not only requires time, effort and skill to alter or remove, but also involves a significant cost factor to the person desiring to remove such marking making it uneconomical to steal a vehicle so marked.

SUMMARY

This invention relates to the method and apparatus used for stenciling selected indicia upon and into surfaces of structures for identification purposes. The apparatus of the present invention basically comprises an outer casing, an aperture for insertion of a stencil holding unit in the front of the casing of sufficient size to hold the unit stencils desired to be used, means for detachably inserting and retaining the unit stencils in the stencil holding unit, and means for applying the stenciling medium from within the apparatus through the unit stencils onto the surface to be marked. The casing aperture can be rectangular in shape and have retaining means along its edges for holding a series of unit stencils whose stenciling indicia can be individual numbers, letters or symbols having interlocking edge engagements on each unit stencil member.

One embodiment of the device of this invention is designed to sandblast a sequence of indicia into glass. In this embodiment the aperture in the front of the outer casing is covered by a stencil holding unit made of a resilient material which has a front rectangular opening surrounded by a unit stencil receptacle area which has horizontal lips undercut along it upper and lower sides and with vertical end flange receptacle slots for receipt of the end flange portion of the end unit stencil members. It is envisioned that the front rectangular opening of the stencil holding unit can be of varied sizes to accommodate a plurality of unit stencils. At the rear of the outer casing is a circular aperture into which an O-shaped rubber, or equivalent flexible material, gasket is affixed to the inner circumference of the aperture. The inner circumference of this gasket makes tight contact with the nozzle of a pistol-type compressed air supply and the outer circumference of the gasket making tight contact with the circumference of the aperture in the rear of the casing thereby preventing the escape of air and stenciling medium through this aperture when the apparatus is in use. This nozzle supplies high-velocity air through the interior of the casing directed toward the stencil holding unit. The flow of compressed air is trigger-controlled and an air outlet is provided in the casing covered by a grid and a mesh to allow the passage of air and still prevent the escape of sand. Before using, one places sandblast sand or other stenciling medium to be used into the casing through the front aperture and replaces the stencil holding unit. In operation, the sand is cycled from the sand holding area at the bottom of the casing through the sand pickup pipe in which is contained a venturi communicating with the nozzle of the pistol-type compressed air supply whereby the sand is carried into the air stream. The pistol-type compressed air supply member is pivotally mounted for limited azimuthal movement of the nozzle in order to scan the unit stencils within the stencil holding unit in order to blast the sand through the indicia openings. The unit stencils can be provided in sets to allow for a plurality of different indicia combinations. The unit stencils are engaged with one another in such manner as to be easily and quickly interchangeably attached and can be placed in any desired sequence. These unit stencils can be engaged with end unit stencils whose indicia, usually a dot, indicate the beginning and end of a sequence of indicia to prevent later alteration or addition of stenciled indicia. When the unit stencils are in position, they lie flush with the flat front face of the stencil holding unit. The end unit stencils have end flanges to fit into the end flange receptacle slots located along the vertical sides of the unit stencil receptacle area of the stencil holding unit, which end flanges prevent sand from leaking out around the vertical edges of the series of unit stencils and thereby preventing marring of the surface to be marked.

When the apparatus is ready for use, the stencil holding unit contains a series of unit stencils in a desired sequence. The front of the apparatus is then pressed against the glass surface to be marked thereby causing the resilient material of the unit stencil holder to form a seal against the glass. When the trigger of the apparatus is pulled, compressed air shoots forward causing sand to be drawn up from the sand holding area in the bottom of the casing through the sand pickup pipe and the venturi. The sand is carried up the sand pickup pipe into the nozzle member by the suction created by the venturi and is then drawn into the strong current of the pistol-type compressed air supply and is forced through the stencil openings in the unit stencils in order to mark the glass. This sandblasting process marks the glass by wearing away portions of the glass surface under the indicia of the unit stencils. During the sandblasting process the air nozzle moves slowly back and forth between the sides of the nozzle azimuthal movement limiter thereby causing the sandblasting through the unit stencils to give even markings on the glass. The sand not passing through the unit stencils settles into the sand holding area at the bottom of the casing and is picked up again by the venturi-caused vacuum into the sand pickup pipe and thereby recycled. The apparatus of this invention can be used not only horizontally but also at an angle without the sand from the sand holding area falling forward through the unit stencils because the curvature of the lower front casing helps to keep the sand in the sand holding area.

The method of use of the apparatus of this invention can be of great value in identifying automobiles and other motor vehicles incorporating glass in their design. It is envisioned that this apparatus can mark the same identification indicia upon each pane of glass of a vehicle in an inobtrusive spot and each vehicle so marked would possess its own combination of indicia. For example, on a four-door sedan there could be six similar identification marks on each pane of glass, one being on the windshield, another on the rear window, and one on each of the panes of glass of the doors. It has been found that the stencil indicia can be comprised of letters wherein a five-letter series would give a large number of combinations sufficient for a nationwide coding system. Of course the length of the series could be expanded to include more than five letters. These combinations can be preselected by a computer and preassigned in registration-form booklets to dealers authorized to place the identification markings upon the automobile windows. It should be noted that the same letter combination would not be issued more than once. It is also anticipated that objectionable combinations of letters could be eliminated. The code of each identification mark, the owner's name, address and other pertinent information could be filed in a central depository and, should a motor vehicle so marked be stolen and later recovered, the owner could be located not only through the vehicle's own identification numbers, if these have not been altered, but also through the code indicia of the glass markings. While it is possible at this time to change the automobile identification number of a car by removing the sheet metal panel in which it is located and also possible to obliterate the engine number of a vehicle by grinding it off the engine block, the cost of these changes would not deter thieves from engaging in these practices. However, if a thief wished to remove identification sandblasted into the panes of glass on a motor vehicle by installing new panes of glass, the cost of such installation would be prohibitive. An alternative to total replacement of each pane of glass so marked could be the grinding off of the indicia. However, the removal of the marked indicia by grinding would be fruitless since it would be immediately obvious that the indicia had been ground off. Other alterations of the sandblasted identification marks would be difficult and the change would be noticeable on visual and manual inspection.

Therefore it is an object of this invention to provide an easy-to-use self-contained stenciling apparatus in which the medium used for stenciling, such as sandblasting sand, paint, dye or equivalent is contained within the device so that the imprinting can be performed quickly and easily.

Further it is an object of this invention to provide an apparatus in which the unit stencils can be changed quickly and easily by minimally trained individuals to make a large scale motor vehicle identification system economical.

Another object of this invention is to provide a system of motor vehicle identification which would act as a deterrent to the theft of a motor vehicle so marked.

BRIEF DESCRIPTION OF THE DRAWINGS

FIG. 6 illustrates a cut-away side view of the body of the apparatus showing the nozzle and sand holding area.

FIG. 7 illustrates a stencil holding unit.

FIG. 8 illustrates section A — A through the stencil holding unit.

FIG. 9 illustrates section B — B through the stencil holding unit shown in FIG. 7.

FIG. 10 illustrates a unit stencil in two positions and an end unit stencil.

FIG. 11 shows an enlarged sectional view of the triangular supportive member of the unit stencils illustrating their means of interlocking.

DESCRIPTION OF THE PREFERRED EMBODIMENT

Figure 1:
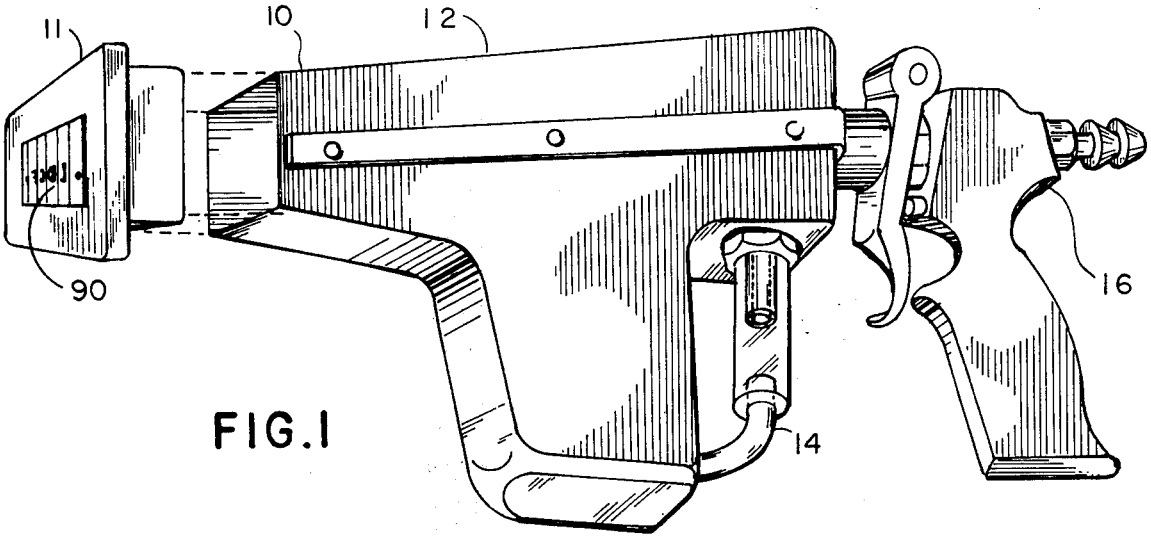
FIG. 1 illustrates a side view of the device of this invention.

FIG. 1 illustrates the embodiment of the stenciling apparatus 10 of the present invention showing stencil holding unit 11, body 12, sand pickup pipe 14 and pistol-type compressed air supply member 16. The body can be comprised of fiberglas or other rigid material with sufficient strength to withstand the air pressure utilized and of sufficient hardness so as not to be worn away by the sandblasting operations carried on within the body. Stencil holding unit 11 can be constructed of a resilient material such as rubber, synthetic plastic or equivalent and is discussed in further detail below. Shown within stencil holding unit 11 are a series of unit stencils 90.

Figure 2:
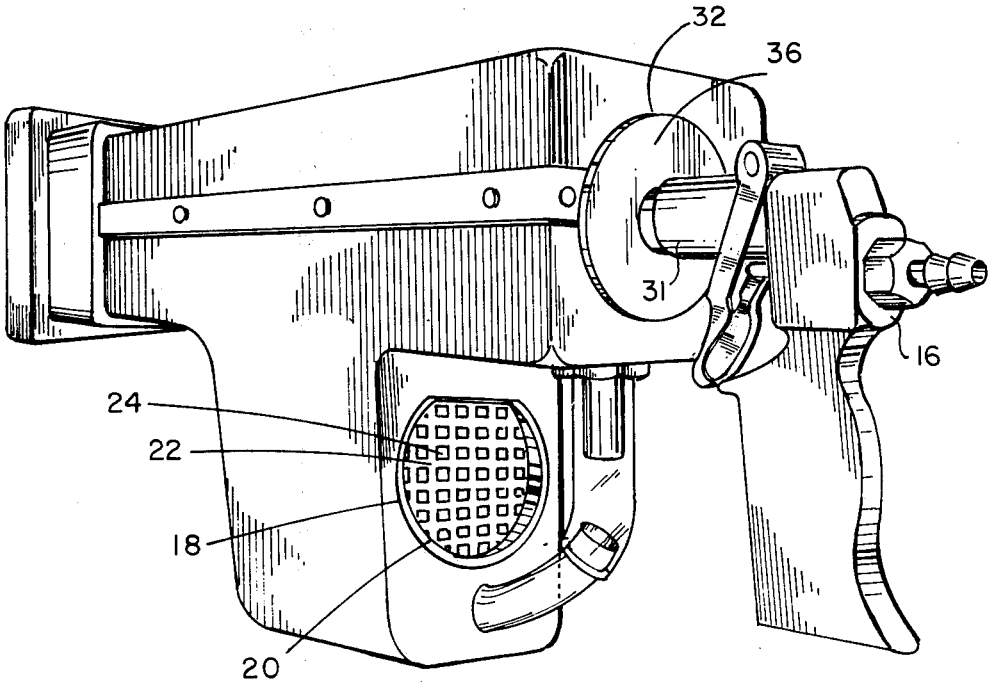
FIG. 2 illustrates a perspective three-quarter rear view of the device of this invention.

In FIG. 2 air pressure outlet 18 has air outlet covering member 20 fitted tightly within its opening. Grid 22 has large openings and mesh 24, with fine openings, is located behind the grid. The air outlet and its associated grid and mesh covering are further illustrated in FIG. 5. This mesh must be fine enough to prevent sand or other stenciling medium from escaping, but the openings in the mesh must be large enough to allow air to escape from the body of the apparatus. Further shown in FIG. 2 is rear circular aperture 32 through which pistol-type compressed air supply member 16 is introduced into the body of the apparatus. To seal this pistol-type compressed air supply member and prevent air from escaping through aperture 32, rear gasket member 36 is utilized. This doughnut-shaped gasket has a groove around its outer circumference which fits tightly over the front and rear of the rim of circular aperture 32. The inner circumference of gasket 36 fits tightly around the barrel 37 of pistol-type compressed air supply member 16 and effectively prevents air from escaping while allowing the pistol-type compressed air supply member 16 to have horizontal azimuthal movement. It has been found that an air pressure range of between 60 lbs/square inch and 120 lbs/square inch gives satisfactory results.

Figure 3:
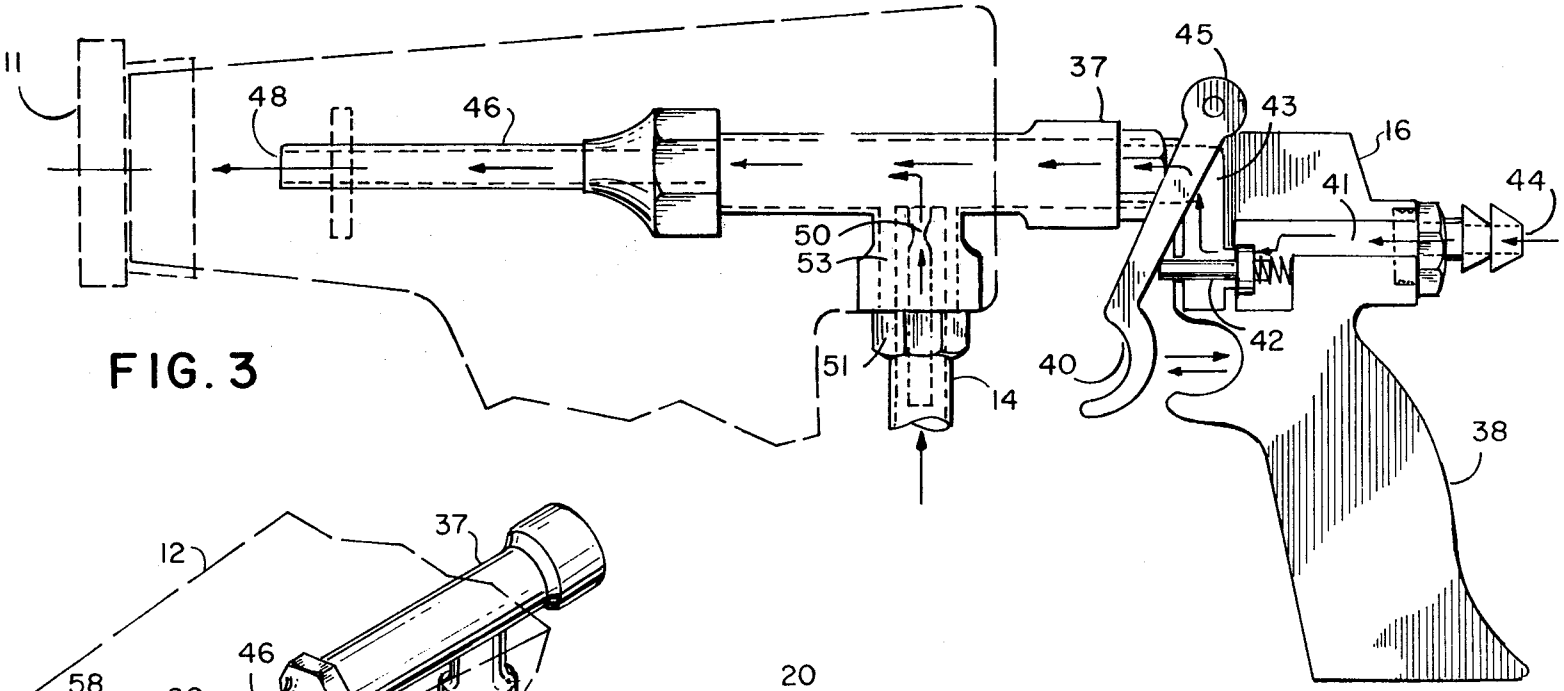
FIG. 3 illustrates a cross-sectional view showing the pistol-type compressed air supply member, its nozzle and associated sand pickup pipe.

FIG. 3 shows a cross-sectional view of pistol-type compressed air supply member 16. Trigger 40 of handle 38 actuates spring-loaded plunger 42 to allow air to enter from air inlet 44 and pass through first entry chamber 41, barrel entry chamber 43, and proceed down barrel 37 terminating in elongated nozzle 46 which has a diameter less than that of barrel 37. Trigger 40 pivots about axial point 45 to actuate plunger 42. As the air passes through barrel 37 towards outlet 48, it passes over venturi 50 which terminates sand pickup pipe 14. This passage of air over the venturi creates a vacuum causing a suction which draws sand up through sand pickup pipe 14 from stenciling medium holding area 62. The stenciling medium holding area, pickup pipe and venturi are further shown in FIG. 6. The sand is then blown through barrel 37 and the nozzle and forced through the indicia openings of the unit stencils retained within stencil holding unit 11.

Figure 4:
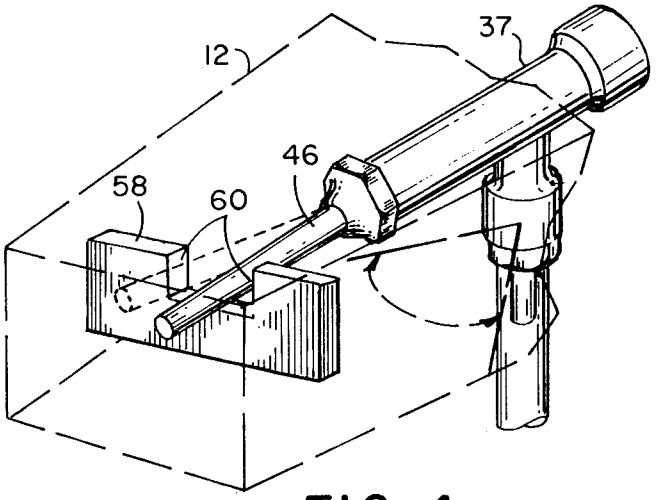
FIG. 4 illustrates the nozzle with azimuthal movement limiter in position within the body of the apparatus.

FIG. 4 illustrates in a cutaway view of the casing to expose nozzle 46 and azimuthal movement limiter 58 which is positioned between the sides of the outer casing and which limits the horizontal movement of nozzle 46 and barrel 37 of the pistol-type compressed air supply member. Sides 60 of azimuthal movement limiter 58 prevent nozzle 46 from being directed beyond the areas where the unit stencils have their indicia. In FIG. 3, barrel 37 is pivotally mounted on member 51 through which the venturi and sand pickup pipe are interconnected allowing horizontal azimuthal movement.

Figure 5:
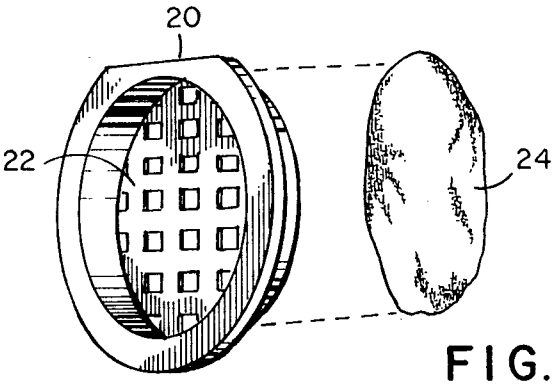
FIG. 5 illustrates the air outlet covering member with its supporting grid and associated fine mesh covering.

FIG. 5 illustrates air outlet covering member 20 showing supporting grid 22 and fine mesh 24 which is illustrated in a separated position from the air outlet member. In practice, mesh 24 is sealed against grid 22.

FIG. 6 illustrates a sectional cutaway view of the casing body 12 showing stenciling medium holding area 61 formed of slanted false bottom 62 which slantingly extends from a low front portion to a rear high portion of which is located inlet 64 of the pickup pipe which runs up to nozzle 66 of the pistol-type compressed air supply member. It should be noted that inlet 64 of the pickup pipe is located at the lowest point of the sand holding area. It has been found that this position of the inlet assists the sand after it has been blown against the stencil holding unit and has fallen back down the curved slanted lower front section of the casing into the sand holding area to be recycled in the sand blasting process. A flexible section 63 of the sand pickup pipe made of plastic or other flexible material assists in allowing the pivotal movement of the pistol-type air supply member.

FIG. 7 illustrates stencil holding unit 11 to be fitted within aperture 13 of FIGS. 1 and 6 which can be constructed of rubber, vinyl plastic or equivalent material and shows the unit stencil horizontal inner and outer complementary retaining members which retain each unit stencil. These retaining members are comprised of angular converging horizontal inner lips, 70*a* and 70, and outer lips, 72*a* and 72, within which the unit stencils are positioned and secured and end unit stencil member side flanges 73*a* and 73*b* which define receptacle slots 75*a* and 75*b*.

FIG. 8 shows a sectional view through section A — A of FIG. 7 wherein can be seen retaining member angular lips 78 and along with rectangular aperture 80 through which the sand is blasted and the wall section 81 of the stencil holding unit which engages the body of this device.

FIG. 9 illustrates a sectional view through section B — B of FIG. 7 wherein end unit stencil member flange receptacle slots 75 and 75*a* are visible. Also illustrated are retaining angular converging lips 70 and 72 retaining member 90 with aperture 80 through which the stencil medium passes. Body engagement section 81 is partially visible in this cross section.

FIG. 10 illustrates unit stencil 90 with its indicia "L" 100 in an upright position and with its right side visible. The unit stencil 90*a* in FIG. 11 with its indicia "L" 100 but is shown turned 180 degrees so that its left side is visible. At the upper and lower end of the unit stencil are triangular end members 102 and 104 which when placed in the stencil holding unit are retained by the lips 70 and 72 and lips 70*a* and 72*a* as best shown in FIG. 8. The flexibility of the stencil holding unit allows the lip portions to be manually opened for insertion of the unit stencils and upon release to return to its original position, thereby retaining the unit stencils within the stencil holding unit. In FIG. 12 unit stencils 11 are shown retained within stencil holding unit 11. The end unit stencil member 98 has end flange member 110 which is received within the end flange receptacle slot 75 or 75*a* of the stencil holding unit. End flange receptacle slot 86 is best shown in FIG. 9. End flange receptacle slot 110 assists the unit stencils as a group to be held firmly within the stencil holding unit and also prevents sand or other stenciling medium from leaking through the vertical edges of the series of unit stencils when in position.

FIG. 13 illustrates enlarged sectional views of the unit stencil member 90 as shown in FIG. 10 in order to illustrate this unit's interlocking mechanism. At the upper and lower end of each unit stencil is triangular end member 102 (member 104 not illustrated), having on its inner edge of one side, triangular protrusion 106 and on its other side, a matching receiving indentation 108. Further interlocking is achieved by protrusion 105 along the body of unit stencil member 90 which is received by indentation 107. These interlocking units are also found on the side of an end unit stencil which meshes with the other unit stencils. These interlocking members serve to strengthen the structures of the series of unit stencils and to prevent sand from leaking between the unit stencils. It should be noted that the resiliency of the stencil holding unit allows for sufficient lateral movement for manual flexing of the stencil holding unit to easily disengage one unit stencil from another in order to change the stenciling indicia identification marking. It should be further noted as more clearly seen in FIG. 10 that the indicia are not centered on the unit stencil but are offset to one end so that one may see whether a letter is backwards as it would be out of line with the other letters. Also if a letter is inserted in an upside down position, its interlocking mechanism will not mesh with the adjacent unit stencils.

Numerous modifications, embodiments and changes will be readily apparent to those skilled in the art. The invention is therefore not to be construed to be strictly limited to the foregoing disclosure as such changes, modifications and embodiments may be made without departing from the spirit and scope of the present invention.

I claim:

1. A stenciling apparatus of the type having a pistol-type compressed air supply member comprising:

a hollow casing having a rear end portion receiving said air supply member, a front end portion defining a rectangular aperture and a lower stenciling medium recycling and holding area;

a stencil holding unit, having a circumscribed interior rectangular aperture smaller than said casing aperture, positioned within and over said casing aperture;

means incorporated within said stencil holding unit about said rectangular stencil holding unit aperture, for forming two parallel retaining grooves of resilient converging lips extending lengthwise and for forming abutting side retaining slots of overlapping flanges;

a plurality of rectangular body unit stencilling indicia members having triangularly shaped end members perpendicularly affixed along the width thereof capable of being engageable within said retaining groove resilient converging lips;

at least two rectangular body end unit stencil indicia members having said triangularly shaped end members for insertion into said retaining groove within said overlapping flanges and having a protruding flange abutting the length of one side of said stencil member capable of being engageable within said retaining groove slot flange;

means for engagingly overlapping and interlocking said triangular end members and said rectangular stencil body member;

a false bottom within said stencilling medium holding area which slants downwards from the rear to the front of said stenciling medium holding area;

a barrel connected with said compressed air supply for delivering compressed air through said casing;

an elongated nozzle affixed to said barrel to direct and deliver said stenciling medium through said stencil holding unit aperture to said stenciling unit indicia;

a stenciling medium pickup pipe extending from the lowest frontal portion of said stenciling medium holding area through said casing and said false bottom to communicate with and deliver said stenciling medium to said barrel; and means for releasing air pressure from said casing positioned in said casing above the rear upper extent of said false bottom.

2. The apparatus as recited in claim 1 wherein each of said unit stencil member interlocking and overlapping means include a protruding triangular flange extending from one corresponding side of each of said triangular end members and a complimentary mating triangular indentation upon the opposing side of each of said triangular end members, said means further including a protruding flange extending the length of one edge of the body of said unit stencil to overlap on adjacent unit stencil.

3. The stenciling apparatus as recited in claim 1 wherein a sloping curvature casing portion interposes said front casing portion and said lower stencil medium holding area casing portion.

4. The stenciling apparatus as recited in claim 1 wherein said barrel is pivotally mounted within and upon a rearwardly protruding portion of said rear casing portion and wherein a horizontal movement limiter positioned in said forward casing portion limits the horizontal pivotal movement of said barrel and said nozzle.

5. A stenciling apparatus of the type having a pistol-type compressed air supply member for stenciling medium delivery means comprising:

a hollow casing having a rear end portion receiving said air supply member, a front end portion defining a rectangular aperture and a lower stenciling medium and recycling area, said front and lower casing portions being interposed by means of a sloping curvature casing portion;

a stencil holding unit, having a circumscribed interior rectangular aperture smaller than said casing aperture positioned within and over said casing aperture;

means about said stencil holding unit aperture for forming two parallel retaining grooves of two resilient converging lips for each of said grooves and for forming two retaining groove slots by means of overlapping flanges, said slots perpendicularly abutting said retaining grooves;

a plurality of rectangular body unit stenciling indicia members having triangularly shaped end members, perpendicularly affixed along the stencil body width, capable of being engageable within said retaining groove converging lips;

at least two rectangular body end unit stencil indicia members having said triangularly shaped end members for insertion into said retaining groove and having a protruding flange member, abutting the length of the body of one side of said stencil member, capable of being engageable within said retaining slot and flange;

each of said unit stencils having a protruding triangular flange extending from one corresponding side of each of said triangular end members and having a complimentary mating triangular indentation upon the opposing side of each of said triangular end members for interlocking adjacent unit stencil members; and each of said unit stencils having a protruding flange extending the length of one edge of the body of said unit stencil member for overlapping adjacent unit stencil members.

* * * * *